US009328569B2

(12) United States Patent
Gilmore et al.

(10) Patent No.: US 9,328,569 B2
(45) **Date of Patent: *May 3, 2016**

(54) GOOSENECK CONDUIT SYSTEM

(71) Applicant: Cameron International Corporation, Houston, TX (US)

(72) Inventors: David L. Gilmore, Baytown, TX (US); William F. Puccio, Katy, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/490,582

(22) Filed: Sep. 18, 2014

(65) Prior Publication Data

US 2015/0000924 A1 Jan. 1, 2015

Related U.S. Application Data

(62) Division of application No. 13/274,947, filed on Oct. 17, 2011, now Pat. No. 8,863,845.

(60) Provisional application No. 61/500,914, filed on Jun. 24, 2011.

(51) Int. Cl.

| | |
|---|---|
| ***E21B 19/00*** | (2006.01) |
| ***E21B 17/01*** | (2006.01) |
| ***E21B 21/02*** | (2006.01) |

(52) U.S. Cl.

CPC ..... *E21B 19/006* (2013.01); *E21B 17/01* (2013.01); *E21B 21/02* (2013.01)

(58) Field of Classification Search

CPC ..... E21B 19/006; E21B 21/02; E21B 17/01
USPC ..... 166/338, 339, 341, 342, 344, 345, 350, 166/359, 367, 378–381
See application file for complete search history.

(56) References Cited

U.S. PATENT DOCUMENTS 5,727,630 A * 3/1998 Brammer ..... 166/355
8,863,845 B2 * 10/2014 Gilmore et al. ..... 166/338

* cited by examiner

*Primary Examiner* — James G Sayre
(74) *Attorney, Agent, or Firm* — Chamberlain Hrdlicka

(57) ABSTRACT

A gooseneck conduit system for use with a telescoping joint of a subsea riser. In one embodiment, a riser telescoping joint includes a tube and a gooseneck conduit assembly affixed to the tube. The gooseneck conduit assembly includes a gooseneck conduit extending radially from the tube, and a tenon projecting from a rear face of the gooseneck conduit. The width of the tenon increases with distance from the rear face. The riser telescoping joint also includes a mortise channel extending along the length of the tube. The mortise channel is interlocks with the tenon and laterally secures the gooseneck conduit assembly to the tube.

19 Claims, 7 Drawing Sheets

GOOSENECK CONDUIT SYSTEM

CROSS-REFERENCE TO RELATED APPLICATIONS

This application is a divisional of U.S. application Ser. No. 13/274,947, filed on Oct. 17, 2011, which is a non-provisional of U.S. Provisional Application No. 61/500,914, filed on Jun. 24, 2011, both of which is hereby incorporated herein by reference in its entirety for all purposes.

BACKGROUND

Offshore oil and gas operations often utilize a wellhead housing supported on the ocean floor and a blowout preventer stack secured to the wellhead housing's upper end. A blowout preventer stack is an assemblage of blowout preventers and valves used to control well bore pressure. The upper end of the blowout preventer stack has an end connection or riser adapter (often referred to as a lower marine riser packer or LMRP) that allows the blowout preventer stack to be connected to a series of pipes, known as riser, riser string, or riser pipe. Each segment of the riser string is connected in end-to-end relationship, allowing the riser string to extend upwardly to the drilling rig or drilling platform positioned over the wellhead housing.

The riser string is supported at the ocean surface by the drilling rig. This support takes the form of a hydraulic tensioning system and telescoping (slip) joint that connect to the upper end of the riser string and maintain tension on the riser string. The telescoping joint is composed of a pair of concentric pipes, known as an inner and outer barrel, that are axially telescoping within each other. The lower end of the outer barrel connects to the upper end of the aforementioned riser string. The hydraulic tensioning system connects to a tension ring secured on the exterior of the outer barrel of the telescoping joint and thereby applies tension to the riser string. The upper end of the inner barrel of the telescoping joint is connected to the drilling platform. The axial telescoping of the inner barrel within the outer barrel of the telescoping joint compensates for relative elevation changes between the rig and wellhead housing as the rig moves up or down in response to the ocean waves.

According to conventional practice, various auxiliary fluid lines are coupled to the exterior of the riser tube. Exemplary auxiliary fluid lines include choke, kill, booster, and hydraulic fluid lines. Choke and kill lines typically extend from the drilling rig to the wellhead to provide fluid communication for well control and circulation. The choke line is in fluid communication with the borehole at the wellhead and may bypass the riser to vent gases or other formation fluids directly to the surface. According to conventional practice, a surface-mounted choke valve is connected to the terminal end of the choke conduit line. The downhole back pressure can be maintained substantially in equilibrium with the hydrostatic pressure of the column of drilling fluid in the riser annulus by adjusting the discharge rate through the choke valve.

The kill line is primarily used to control the density of the drilling mud. One method of controlling the density of the drilling mud is by the injection of relatively lighter drilling fluid through the kill line into the bottom of the riser to decrease the density of the drilling mud in the riser. On the other hand, if it is desired to increase mud density in the riser, a heavier drilling mud is injected through the kill line.

The booster line allows additional mud to be pumped to a desired location so as to increase fluid velocity above that point and thereby improve the conveyance of drill cuttings to the surface. The booster line can also be used to modify the density of the mud in the annulus. By pumping lighter or heavier mud through the booster line, the average mud density above the booster connection point can be varied. While the auxiliary lines provide pressure control means to supplement the hydrostatic control resulting from the fluid column in the riser, the riser tube itself provides the primary fluid conduit to the surface.

A hose or other fluid line connection to each auxiliary fluid line coupled to the exterior of the riser tube is provided at the telescoping joint via a pipe or equivalent fluid channel. The pipe is often curved or U-shaped, and is accordingly termed a "gooseneck" conduit. In the course of drilling operations, a gooseneck conduit may be detached from the riser, for example, for maintenance or to permit the raising of the riser through the drilling floor, and reattached to the riser to provide access to the auxiliary fluid lines. The gooseneck conduits are typically coupled to the auxiliary fluid lines via threaded connections.

SUMMARY

A gooseneck conduit system for use with a telescoping joint of a subsea riser is disclosed herein. In one embodiment, a riser telescoping joint includes a tube and a gooseneck conduit assembly affixed to the tube. The gooseneck conduit assembly includes a gooseneck conduit extending radially from the tube, and a tenon projecting from a rear face of the gooseneck conduit. The width of the tenon increases with distance from the rear face. The riser telescoping joint also includes a mortise channel extending lengthwise along the tube. The mortise channel interlocks with the tenon to laterally secure the gooseneck conduit assembly to the tube.

In another embodiment, a gooseneck conduit unit includes a plate, a gooseneck conduit, and a bumper. The gooseneck conduit is removably mounted to the plate. The bumper is coupled to a rear face of the gooseneck conduit. The bumper includes a tenon that guides the gooseneck conduit unit into position on a telescoping joint.

In a further embodiment, a system includes a telescoping joint. The telescoping joint includes an alignment ring and a gooseneck conduit assembly. The alignment ring is circumferentially coupled to a tube of the telescoping joint. The alignment ring includes a longitudinal mortise channel. The gooseneck conduit assembly is coupled to the alignment ring. The gooseneck conduit assembly includes a gooseneck conduit and a tenon. The tenon slidingly engages sides of the mortise channel to secure the gooseneck conduit assembly to the alignment ring.

BRIEF DESCRIPTION OF THE DRAWINGS

For a detailed description of exemplary embodiments of the invention, reference will now be made to the accompanying drawings in which.

NOTATION AND NOMENCLATURE

Figure 1A:
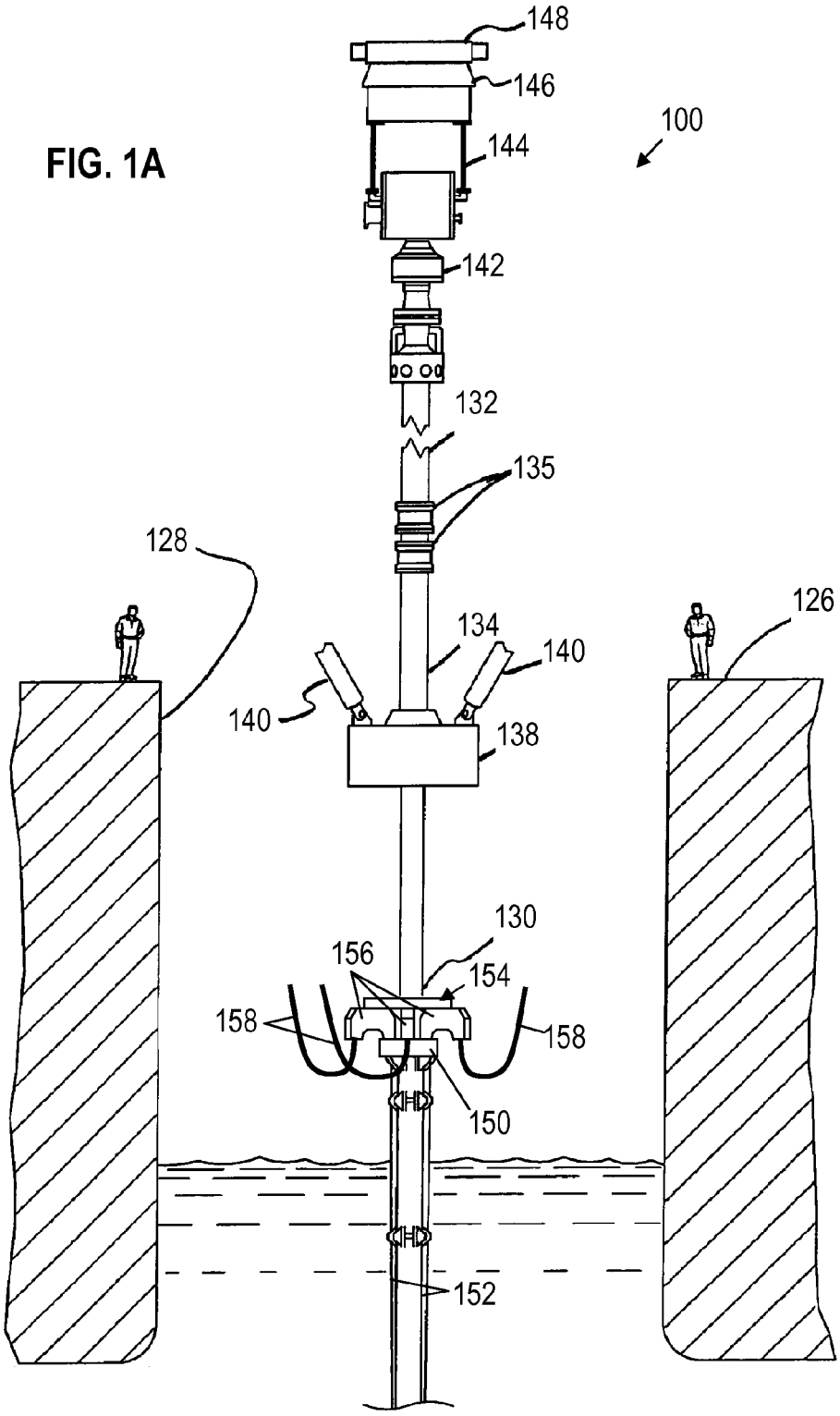
FIGS. 1A-1B show a drilling system including a gooseneck conduit system in accordance with various embodiments.

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices and connections.

DETAILED DESCRIPTION

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

The size and weight of the gooseneck conduits, and the location of the attachment points of the conduits to the telescoping joint and the auxiliary fluid lines, makes installation and/or retrieval of the conduits a labor-intensive process. Consequently, gooseneck conduit handling operations can be time consuming and costly. Embodiments of the present disclosure include a gooseneck conduit system that reduces handling time and enhances operational safety. Embodiments of the conduit system disclosed herein can provide simultaneous connection of gooseneck conduits to a plurality of auxiliary fluid lines with no requirement for manual handling or connection operations. Embodiments include hydraulically and/or mechanically operated locking mechanisms that secure the conduit system to the telescoping joint and the auxiliary fluid lines. The conduit system may be hoisted into position on the telescoping joint, and attached to the telescoping joint and the auxiliary fluid lines via the provided locking mechanisms. Thus, embodiments allow gooseneck conduits to be quickly and safely attached to and/or removed from the telescoping joint.

Figure 1B:
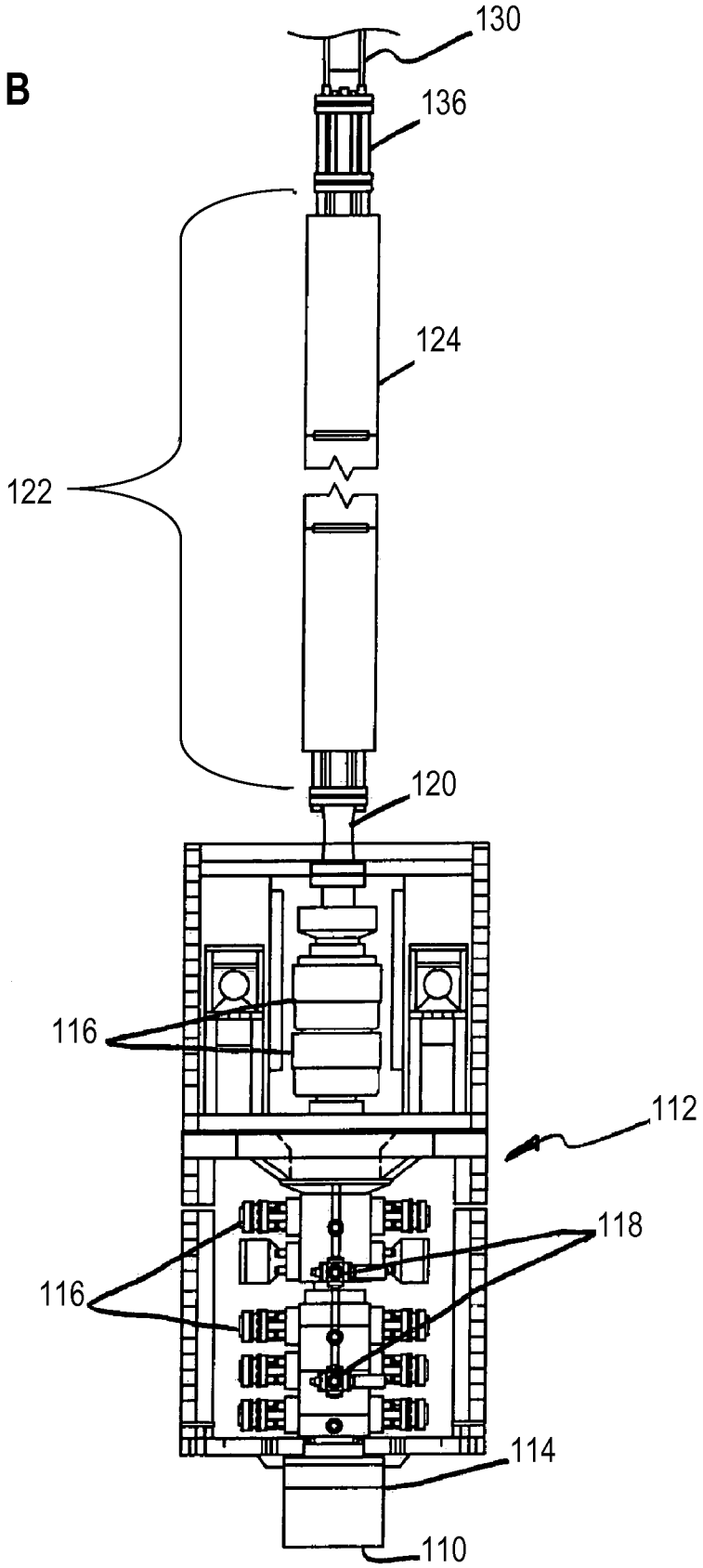

FIGS. 1A-1B show a drilling system 100 in accordance with various embodiments. The drilling system 100 includes a drilling rig 126 with a riser string 122 and blowout preventer stack 112 used in oil and gas drilling operations connected to a wellhead housing 110. The wellhead housing 110 is disposed on the ocean floor with blowout preventer stack 112 connected thereto by hydraulic connector 114. The blowout preventer stack 112 includes multiple blowout preventers 116 and kill and choke valves 118 in a vertical arrangement to control well bore pressure in a manner known to those of skill in the art. Disposed on the upper end of blowout preventer stack 112 is riser adapter 120 to allow connection of the riser string 122 to the blowout preventer stack 112. The riser string 122 is composed of multiple sections of pipe or riser joints 124 connected end to end and extending upwardly to drilling rig 126.

Drilling rig 126 further includes moon pool 128 having telescoping joint 130 disposed therein. Telescoping joint 130 includes inner barrel 132 which telescopes inside outer barrel 134 to allow relative motion between drilling rig 126 and wellhead housing 110. Dual packer 135 is disposed at the upper end of outer barrel 134 and seals against the exterior of inner barrel 132. Landing tool adapter joint 136 is connected between the upper end of riser string 122 and outer barrel 134 of telescoping joint 130. Tension ring 138 is secured on the exterior of outer barrel 134 and connected by tension lines 140 to a hydraulic tensioning system as known to those skilled in the art. This arrangement allows tension to be applied by the hydraulic tensioning system to tension ring 138 and telescoping joint 130. The tension is transmitted through landing tool adapter joint 136 to riser string 122 to support the riser string 122. The upper end of inner barrel 132 is terminated by flex joint 142 and diverter 144 connecting to gimbal 146 and rotary table spider 148.

A support collar 150 is coupled to the telescoping joint 130, and the auxiliary fluid lines 152 are terminated at seal subs retained by the support collar 150. One or more gooseneck conduit assemblies 154 are coupled to the support collar 150 and to the auxiliary fluid lines 152 via the seal subs retained by the support collar 150. Each conduit assembly 154 is a conduit unit that includes one or more gooseneck conduits 156. A hose 158 or other fluid line is connected to each gooseneck conduit 156 for transfer of fluid between the gooseneck conduit 156 and the drilling rig 126. In some embodiments, the connections between the hoses 158 and/or other rig fluid lines and the gooseneck conduits 156 are made on the rig floor, and thereafter the gooseneck conduit assembly 154 is lowered onto the telescoping joint 130.

The gooseneck conduit assembly 154 includes locking mechanisms that secure the conduit assembly 154 to the telescoping joint 130. The conduit assembly 154 can be lowered onto the support collar 150 using a crane or hoist. In some embodiments, the conduit assembly 154 can be connected to hydraulic lines that actuate the locking mechanisms. Thus, embodiments allow the gooseneck conduits 156 to be quickly and safely fixed to and/or removed from the telescoping joint 130 while reducing the manual effort required to install and/or remove the gooseneck conduits 156.

Figure 2:
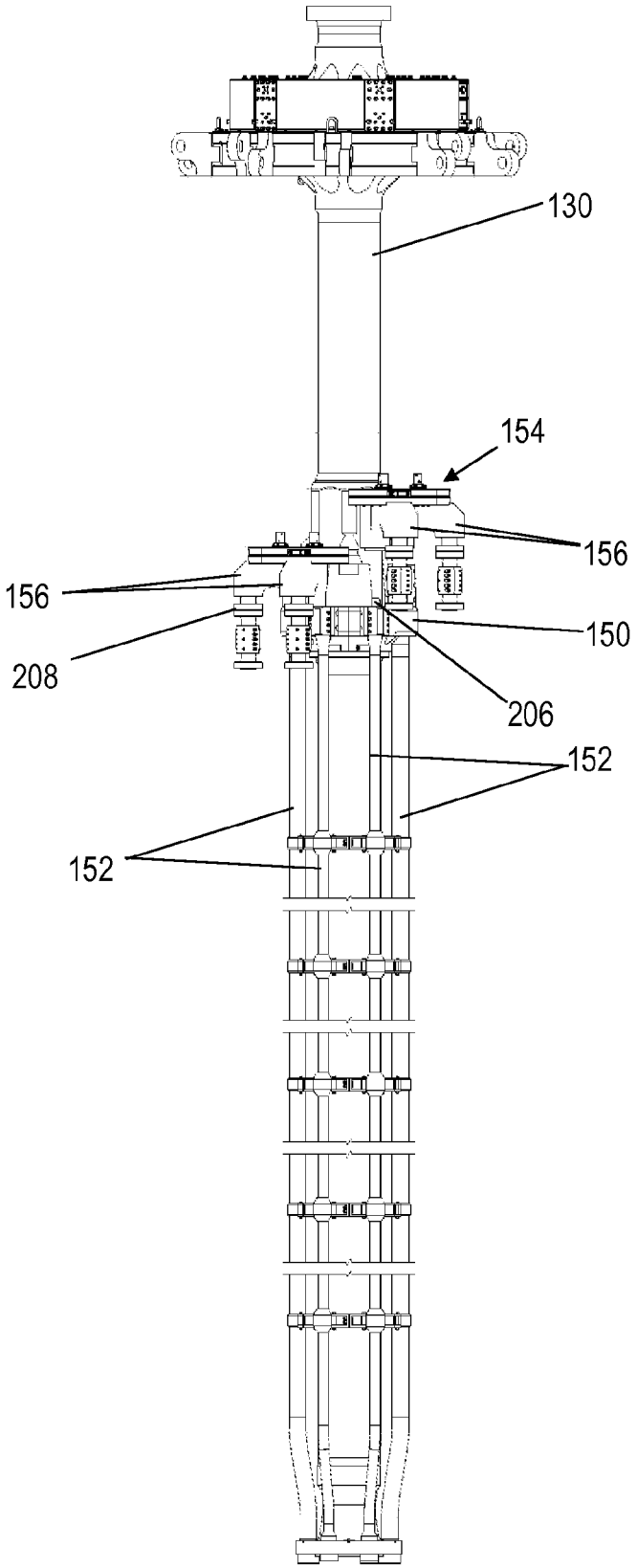
FIG. 2 shows a telescoping joint in accordance with various embodiments.

FIG. 2 shows the telescoping joint 130 in accordance with various embodiments. The auxiliary fluid lines 152 are secured to the telescoping joint 130. The uphole end of each auxiliary fluid line 152 is coupled to a seal sub 206 at the support collar 150. The support collar 150 is coupled to and radially extends from the telescoping joint 130. In some embodiments, the support collar 150 includes multiple connected sections (e.g., connected by bolts) that join to encircle the telescoping joint 130.

The gooseneck conduit assembly 154 includes one or more locking mechanisms, and a plurality of gooseneck conduits 156. As the gooseneck conduit assembly 154 is positioned on the support collar 150, each gooseneck conduit 156 engages a seal sub 206 and is coupled to an auxiliary fluid line 152. The locking mechanisms secure the gooseneck conduit assembly 154 to the support collar 150, and secure each gooseneck conduit 156 to a corresponding auxiliary fluid line 152. In some embodiments, the locking mechanisms are hydraulically operated. In other embodiments, the locking mechanisms are mechanically operated. The locking mechanisms may be either hydraulically or mechanically operated in some embodiments. The gooseneck conduits 156 may include swivel flanges 208 for connecting the conduits 156 to fluid lines 158.

Figure 3:
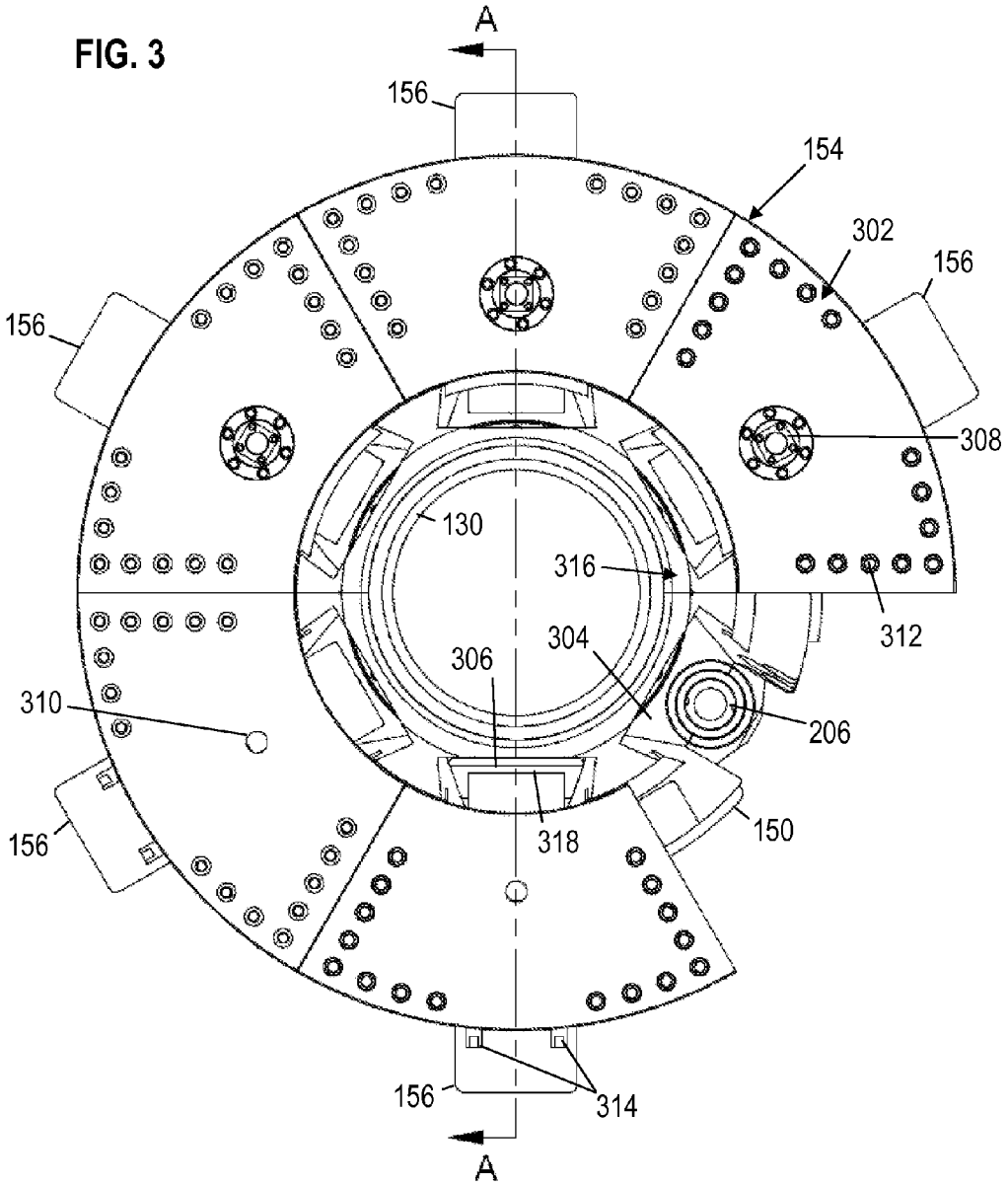
FIG. 3 shows a top view of a plurality of gooseneck conduit assemblies in accordance with various embodiments.

FIG. 3 shows a top view of a plurality of gooseneck conduit assemblies 154 in accordance with various embodiments. Each gooseneck conduit assembly 154 includes one or more gooseneck conduits 156. Each gooseneck conduit assembly 154 includes a top plate 302 and fasteners 312 that connect the top plate 302 to underlying structures explained below. The gooseneck conduit assembly 154 includes a projection or tenon 306 for aligning and locking the gooseneck conduit assembly 154 to the telescoping joint 130. Some embodiments of the gooseneck conduit assembly 154 include a tenon 306 coupled to each gooseneck conduit 156. In some embodiments, the tenon 306 may be trapezoidal, or fan-shaped to form a dove-tail tenon. Other embodiments may include a differently shaped tenon 306. The tenon 306 may be formed by a bumper attached to the rear face 318 of the gooseneck conduit 156, with the bumper, and thus the tenon 306, extending along the length of the rear face 318. In some embodiments, the tenon 306 may be made of bronze or another suitable material. In some embodiments, the tenon 306 may be part of the gooseneck conduit 156.

An alignment guidance ring 316 is circumferentially attached to the telescoping joint 130. The alignment guidance ring 316 includes channel mortises 304 that receive, guide the gooseneck conduits 156 into alignment with the seal subs 206, and retain the tenons 306 as the gooseneck conduit assembly 154 is lowered onto the telescoping joint 130. Consequently, the mortises 304 are shaped to mate with and slidingly engage the tenons 306 (i.e., a trapezoids, dove-tails, etc). The channel mortises 304 may narrow with proximity to the support collar 150 (with proximity to the bottom of the alignment ring 316). Similarly, the tenons 306 may narrow with distance from the top plate 302 (with proximity to the bottom of the rear face 318 of the gooseneck conduit 156). The tenons 306 and mortises 304 are dimensioned to securely interlock.

The gooseneck conduit assembly 154 includes locking mechanisms that secure the gooseneck conduit assembly 154 to the telescoping joint 130. Embodiments may include one or more locking mechanisms that are mechanically or hydraulically actuated. For example, embodiments may include a primary and a secondary locking mechanism. Hydraulic secondary backup locks 308 are included on some embodiments of the gooseneck conduit assembly 154. The hydraulic secondary locks include a hydraulic cylinder that operates the lock. Other embodiments include mechanical secondary backup locks 310. In some embodiments, the secondary backup locks secure the primary locking mechanisms into position. Lock state indicators 314 show the state of conduit assembly locks. For example, extended indicators 314 indicate a locked state, and retracted indicators 314 indicate an unlocked state.

Figure 4:
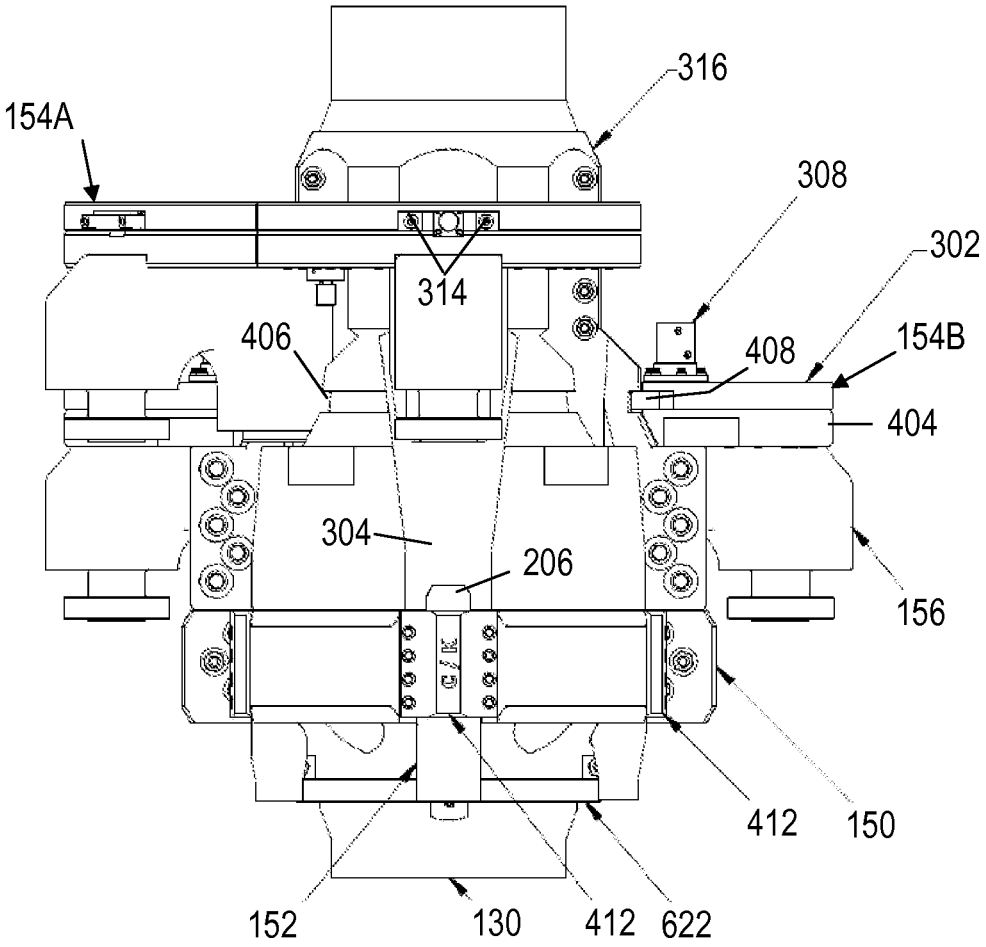
FIG. 4 shows an elevation view of a support collar and gooseneck conduit assemblies in accordance with various embodiments.

FIG. 4 shows an elevation view of the support collar 150 and gooseneck conduit assemblies 154 in accordance with various embodiments. The gooseneck conduit assembly 154A includes two gooseneck conduits 156, and is unlocked and separated from the telescoping joint 130, and positioned above the support collar 150. The gooseneck conduit assembly 154B includes three gooseneck conduits 156, and is secured to the telescoping joint 130 and associated seal subs 206. Each gooseneck conduit 156 is replaceably fastened to a lower support plate 404 by bolts or other attachment devices. The upper support plate 302 is attached to the lower support plate 404. The support collar 150 retains the seal subs 206 via clamps 412 attached to the support collar 150 by bolts or other fastening devices.

The alignment and guidance ring 316 is secured to the telescoping joint 130. The alignment and guidance ring 316 may be formed from a plurality of ring sections joined by bolts or other fastening devices. The alignment and guidance ring 316 includes a locking channel 406. The gooseneck conduit assembly 154B rests on surface 502 (FIG. 5) of the alignment and guidance ring 316, and as discussed above, the tenons 306 interlock with the mortises 304 to laterally secure the gooseneck conduit assembly 154B. The locking member 408 extends from the gooseneck conduit assembly 154B into the locking channel 406 to prevent movement of the gooseneck conduit assembly 154B upward along the telescoping joint 130.

Figure 5:
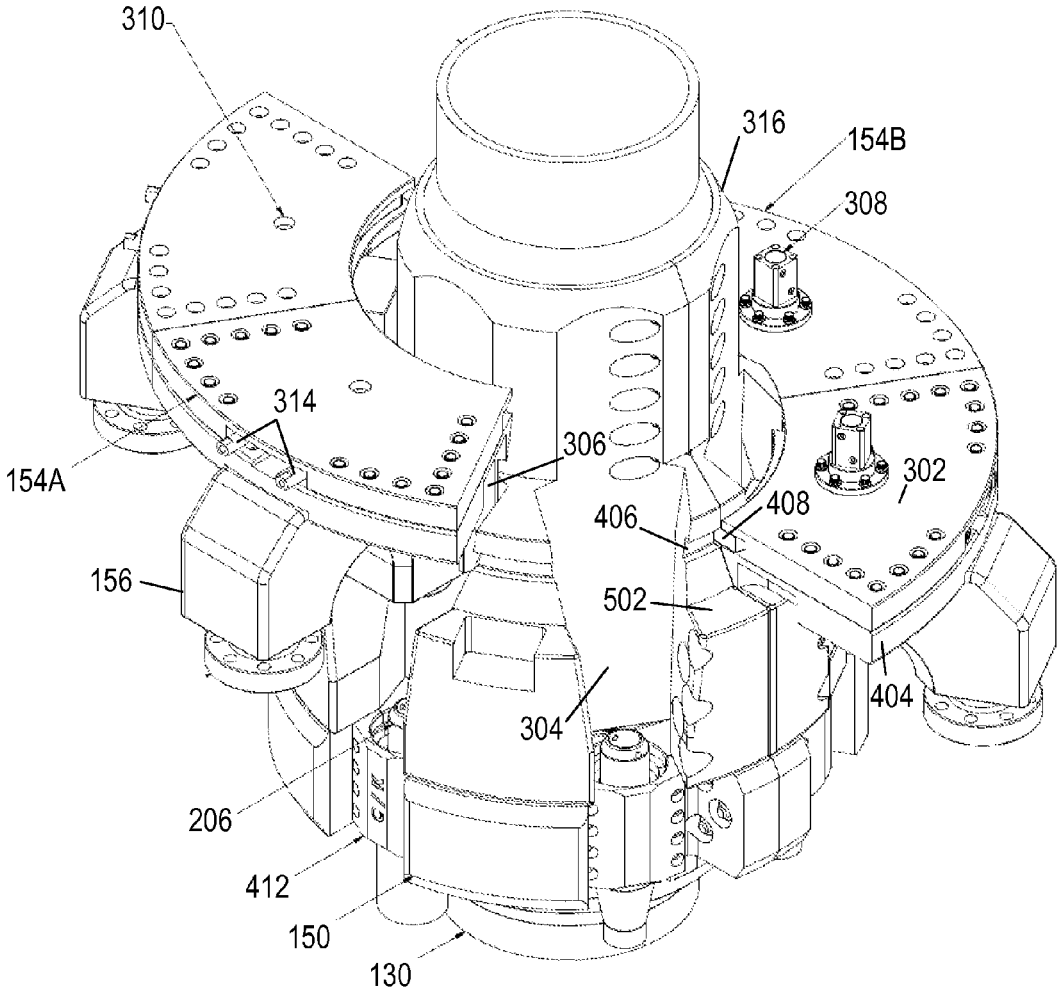
FIG. 5 shows a perspective view of a support collar and gooseneck conduit assemblies in accordance with various embodiments.

FIG. 5 shows a perspective view of the support collar 150 and the gooseneck conduit assemblies 154 as arranged in FIG. 4.

Figure 6:
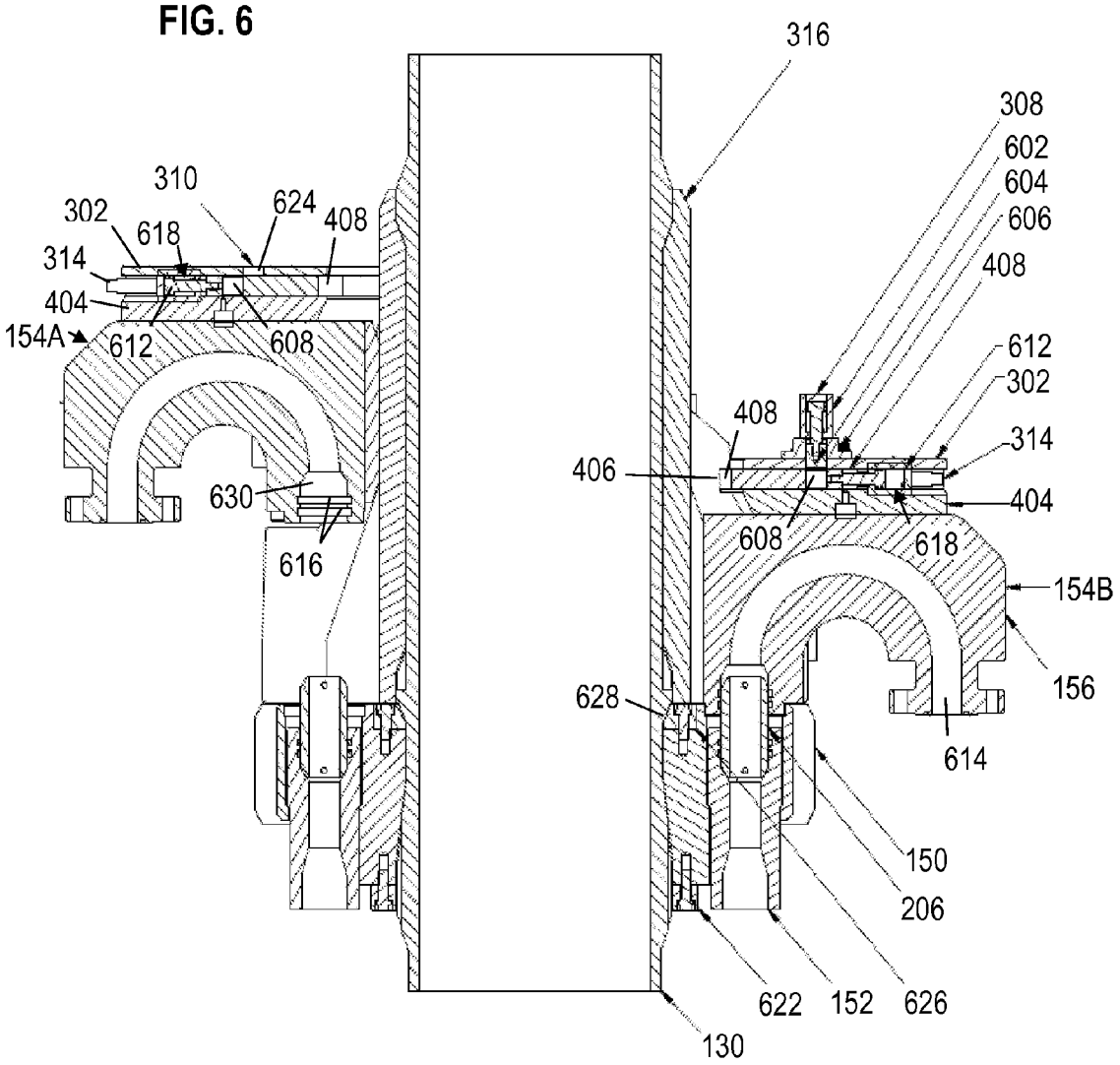
FIG. 6 shows a cross sectional view of a support collar and gooseneck assemblies in accordance with various embodiments.

FIG. 6 shows a cross-sectional view of the support collar 150 and gooseneck conduit assemblies 154 as arranged in FIG. 4. Embodiments of the gooseneck conduits assemblies 154 may include any combination of hydraulic and mechanical primary and secondary locks. The gooseneck conduit assembly 154B includes a hydraulic primary lock 618 and a hydraulic secondary lock 308. The components of the hydraulic primary lock 618 are disposed between the upper and lower support plates 302 and 404. The hydraulic primary lock 618 includes a hydraulic cylinder 612 coupled to the locking member 408 for extension and retraction of the locking member 408.

The components of the hydraulic secondary lock 308 are secured to the upper plate 302 by hydraulic cylinder support plate 606. The hydraulic secondary lock 308 includes a hydraulic cylinder 602 coupled to a locking pin 604 for extension and retraction of the locking pin 604. When the locking member 408 has been extended, extension of the locking pin 604 secures the locking member 408 in the extended position. In some embodiments, the locking member 408 includes a passage 608. The locking pin 604 extends into the passage 608 to secure the locking member 408 in the extended position.

The gooseneck conduit assembly 154A includes a hydraulic primary lock 618 and a mechanical secondary lock 310. As described above, the components of the hydraulic primary lock 618, including the hydraulic cylinder 612, and the locking member 408, are disposed between the upper and lower support plates 302 and 404. In some embodiments, the locking member 408 may be retracted by mechanical rather than hydraulic means. For example, force may be applied to the state indicator 314 to retract the locking member 408 from the locking channel 406. The mechanical secondary lock 310 comprises an opening 624 that allows a bolt or retention pin to be inserted into the passage 608 of the locking member 408 when the locking member 408 is extended.

An upper split retainer 626 and a lower split retainer 622 are attached to the support collar 150 to reduce support collar 150 radial loading. The upper split retainer 626 is bolted to the upper side of the support collar 150, and the lower split retainer 622 is bolted to the lower side of the support collar 150. Each split retainer 626, 622 comprises two sections. The two sections of each retainer 626, 622 abut at a position 90° from the location where the support collar sections are joined. The upper split retainer 626 includes a tapered surface 628 on the inside diameter that retains and positions the support collar 150 on the telescoping joint 130. The support collar 150 also includes a key structure (not shown) for aligning the support collar 150 with a keying structure of the telescoping joint and preventing rotation of the support collar 150 about the telescoping joint 130.

Each gooseneck conduit 156 includes an arcing passage 614 extending through the gooseneck conduit 156 for passing fluid between the auxiliary fluid line 152 and the hose 158. The gooseneck conduit assembly 156 may be formed by a casting process, and the thickness of material between the passage 614 and the exterior surface of the gooseneck conduit 156 may exceed the diameter of the passage 614 (by 2-3 or more times in some embodiments) thereby enhancing the strength and service life of the gooseneck conduit 156. The gooseneck conduit 156 includes a socket 630 that sealingly mates with the seal sub 206 to couple the gooseneck conduit 156 to the auxiliary fluid line 152. The socket 630 includes grooves 616 for holding a sealing device, such as an O-ring, that seals the connection between the gooseneck conduit 156 and the sealing sub 206.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. An assembly to engage with a telescoping joint, comprising:

a plate;

a gooseneck conduit removably mounted to the plate; and a bumper disposed at a rear portion of the gooseneck conduit and configured to mate with the telescoping joint and guide the gooseneck conduit unit into position on the telescoping joint.

2. The assembly of claim 1, wherein the bumper comprises a tenon configured to mate with a mortise channel of the telescoping joint, and wherein the width of the tenon decreases with distance from the plate and increases with distance from the rear face.

3. The assembly of claim 1, further comprising a locking mechanism comprising a primary lock, the primary lock comprising a locking member that is extendable from the rear of the gooseneck conduit unit to secure the gooseneck conduit unit to the telescoping joint.

4. The assembly of claim 3, wherein the locking mechanism comprises a secondary lock, the secondary lock comprising a pin that is extendable to lock the locking member in an extended position.

5. The assembly of claim 3, wherein the primary lock comprises a hydraulic cylinder coupled to the locking member.

6. The assembly of claim 3, further comprising a lock state indicator that visibly indicates whether the locking member is extended.

7. The assembly of claim 1, wherein the gooseneck conduit comprises a fluid flow channel, and the diameter of the fluid flow channel is less than the thickness of material of the gooseneck conduit surrounding the flow channel.

8. An assembly to engage with a telescoping joint, comprising:

a plate; and a gooseneck conduit removably mounted to the plate, the gooseneck conduit comprising a tenon configured to mate with a mortise channel of the telescoping joint to guide the gooseneck conduit into position on the telescoping joint.

9. The assembly of claim 8, further comprising the telescoping joint with the mortise channel.

10. The assembly of claim 8, wherein the tenon is formed with the gooseneck conduit.

11. The assembly of claim 8, wherein the tenon comprises a bumper.

12. The assembly of claim 11, wherein the bumper comprises a material that is softer than that of the gooseneck conduit.

13. The assembly of claim 8, wherein the tenon is positioned at a rear portion of the gooseneck conduit.

14. The assembly of claim 8, wherein the width of the tenon decreases with distance from the plate and increases with distance from the rear face.

15. The assembly of claim 8, further comprising a locking mechanism comprising a primary lock, the primary lock comprising a locking member that is extendable from the rear of the gooseneck conduit unit to secure the gooseneck conduit unit to the telescoping joint.

16. The assembly of claim 15, wherein the locking mechanism comprises a secondary lock, the secondary lock comprising a pin that is extendable to lock the locking member in an extended position.

17. The assembly of claim 15, wherein the primary lock comprises a hydraulic cylinder coupled to the locking member.

18. The assembly of claim 15, further comprising a lock state indicator that visibly indicates whether the locking member is extended.

19. The assembly of claim 8, wherein the gooseneck conduit comprises a fluid flow channel, and the diameter of the fluid flow channel is less than the thickness of material of the gooseneck conduit surrounding the flow channel.

* * * * *